US007418900B2

(12) United States Patent
Fields et al.

(10) Patent No.: US 7,418,900 B2
(45) Date of Patent: Sep. 2, 2008

(54) METHOD FOR CREATING ARTISTIC WORK ON RESIDENTIAL LAWN

(75) Inventors: Riley C. Fields, Charlotte, NC (US); Brian Cox, Charlotte, NC (US); Daniel Lee Bizzell, Davidson, NC (US)

(73) Assignee: Grass Graffiti, LLC, Charlotte, NC (US)

( * ) Notice: Subject to any disclaimer, the term of this patent is extended or adjusted under 35 U.S.C. 154(b) by 0 days.

(21) Appl. No.: 11/926,338

(22) Filed: Oct. 29, 2007

(65) Prior Publication Data

US 2008/0044558 A1 Feb. 21, 2008

Related U.S. Application Data

(63) Continuation-in-part of application No. 11/163,888, filed on Nov. 2, 2005, now Pat. No. 7,334,518.

(51) Int. Cl.
*B05C 17/06* (2006.01)

(52) U.S. Cl. ..... 101/127; 101/127.1; 101/128.4; 101/129

(58) Field of Classification Search ..... None
See application file for complete search history.

(56) References Cited

U.S. PATENT DOCUMENTS 4,652,337 A * 3/1987 Picone et al. ..... 101/128.21
5,101,525 A * 4/1992 Ippolito ..... 135/118
5,195,638 A * 3/1993 Zinbarg ..... 206/457
5,245,715 A * 9/1993 Dinkins ..... 135/118
5,460,087 A * 10/1995 Ogorzalek ..... 101/128.21
5,967,031 A * 10/1999 Gauss ..... 101/129
6,779,443 B2 * 8/2004 Martinez et al. ..... 101/127
7,334,518 B2 * 2/2008 Cox et al. ..... 101/127
7,347,142 B2 * 3/2008 Fields et al. ..... 101/129

* cited by examiner

*Primary Examiner*—Jill E. Culler
(74) *Attorney, Agent, or Firm*—Tillman Wright, PLLC; Chad D. Tillman; James D. Wright

(57) ABSTRACT

Creating an artistic work of art on a lawn includes: unfolding and stretching taut a stencil; driving stakes into the lawn, each stake extending through a corner of the stencil; spraying paint over openings in the stencil; removing the stencil while leaving stakes in place; unfolding and stretching taut a second stencil; anchoring the second stencil by extending corners of the second stencil over stakes driven in the ground; spraying paint over openings in the second stencil. An indication of orientation located on the second stencil is oriented in the same position as that of an indication of orientation of the first stencil. Each stencil includes a planar sheet of flexible film and a gate that extends across an opening of the respective stencil and maintains structural integrity of the stencil and distributes tension in the stencil when the stencil is stretched taut.

20 Claims, 18 Drawing Sheets

METHOD FOR CREATING ARTISTIC WORK ON RESIDENTIAL LAWN

CROSS-REFERENCE TO RELATED APPLICATIONS

The present application is a continuation-in-part patent application of, and claims priority under 35 U.S.C. §120 to, U.S. nonprovisional patent application Ser. No. 11/163,888, filed Nov. 2, 2005, which patent application is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

FIELD OF THE PRESENT INVENTION

The present invention relates to methods and apparatus for creating an artistic work on a lawn and, in particular, to creating a team logo on a residential lawn in a show of support for the team to any passerby.

BACKGROUND OF THE PRESENT INVENTION

Methods and apparatus are known for marking surfaces to enhance special events. The surfaces that may be marked include parking lots, playgrounds, and sports fields.

In one method that is used to create artwork on a sports field, a single stencil first is fastened to the desired area using weights or stencil anchors. Next, a pattern of small openings in the stencil are sprayed with an aerosol turf paint. Spraying of the small openings results in a pattern of dots on the turf. The stencil is then removed, and the aerosol turf paint, for example, is used to connect the dots. The large areas bounded by the connected dots then filled-in with bulk field paint. The method then ends with touch-up of the artwork as desired.

In another similar method, a single stencil is used that includes a pattern of large openings. Spraying of the large openings results in at least an outline of a bounded area that then may be filled-in, for example, after the stencil is removed. This method obviates the connecting of the dots.

A "paw stencil" is commercially available from Tru Mark Athletic Field Marker of Norfolk, Nebr., at www.athleticfieldmarker.com. The paw stencil is a single stencil made from a planar sheet of flexible film having a length of approximately fifteen and one-half feet and width of approximately seventeen and one-half feet and retails for $169. The stencil folds like a bed sheet into a two-foot by two-foot square for easy storage.

Unrelated to the field of the present invention of creating a team logo on a residential lawn, Ogorzalek U.S. Pat. No. 5,460,087 ("Ogorzalek") discloses a stencil kit for decorating architectural structures, i.e., walls, exterior surfaces of houses, and exterior surfaces of commercial buildings, using paint and stencil templates included in the kit. Ogorzalek notes that a common problem with conventional stencil kits for architectural structures is that the structure surfaces are vertical and therefore paint migrates under the stencil templates. To overcome this problem, the stencil template of Ogorzalek includes an adhesive backing so that the stencil template adheres to the surface being painted, and the stencil template includes a foam material layer that allows the surface of the stencil template to be deformed in order to conform with surface irregularities in the exterior surface of the architectural structure." Nothing in Ogorzalek discloses or suggests that the stencil template might be secured to the surface being painted with stakes, nor does anything disclose or suggest the provision of stakes in the stencil kit.

SUMMARY OF THE PRESENT INVENTION

Aspects of the present invention include, inter alia, apparatus and methods for creating artistic works on a residential lawn.

Kits For Creating Artistic Work on Residential Lawn

In one such aspect, a kit for creating an artistic work on a residential lawn broadly includes: a lawn stencil; a container of paint; and a plurality of stakes. The stakes are used to anchor the stencil to the lawn and the paint is used to apply a layer of paint over the lawn stencil, which in turn applies a layer of the paint in a desired pattern on the lawn. In this regard, the lawn stencil includes a pattern of openings therein, which pattern corresponds to one or more design elements of the artwork to be applied to the lawn using the paint. The canister of paint preferably comprises an aerosol.

In a feature of this aspect, the lawn stencil includes anchor openings each for receiving a stake, whereby the stencil is securely anchored to the lawn when the paint is used to apply a layer of paint.

In another feature of this aspect, the kit includes first and second lawn stencils and first and second containers of paint of first and second colors. The first lawn stencil is used to apply a first design element of the artwork in the first color of the first container, and the second lawn stencil is used to apply a second design element of the artwork in the second color of the second container. The first design element is applied using the first lawn stencil and then the second design element is applied using the second lawn stencil. Additional lawn stencils and containers of paint also may be included in this aspect.

Proper alignment and orientation of each of the first and second lawn stencils is important when applying the paint to create the respective design elements of the stencils, as the design elements work together to present the composite image representing the desired artwork.

Accordingly, in a feature of this aspect, each lawn stencil preferably includes an indication of orientation that is arranged in the same manner for all of the lawn stencils. Preferably, such indication of origin can comprise, for example, the word "UP" and an arrow. The indication of orientation thereby is utilized to insure orientation of the pattern of a lawn stencil to the pattern of another lawn stencil.

In a feature of this aspect intended to insure proper alignment of lawn stencils relative to one another when applying the paint, the first lawn stencil includes first and second alignment locations for alignment of the first lawn stencil when the first design elements are applied, and the second lawn stencil includes first and second alignment locations for alignment of the second lawn stencil when the second design elements are applied. Furthermore, the alignment locations of the lawn stencils preferably comprise anchor openings for receiving the stakes for anchoring of the stencils to the lawn. Because these anchor openings of the first and second lawn stencils are known, a pattern of the first lawn stencil can be manufactured relative to the alignment locations of the first lawn stencil, and a pattern of the second lawn stencil can be manufactured relative to the alignment locations of the second lawn stencil, thereby fixing the alignment of the patterns of the two lawn stencils relative to one another.

In still yet another feature of this aspect, a stake includes a circumferential flange dimensioned such that, upon extension of the stake through an anchor opening of the lawn stencil, the stencil is retained between the circumferential flange and the lawn. The circumferential flange thereby tends to keep the stencil from lifting up off of the lawn when, for example, the stencil is being blown by the wind. A stake further may include one or more such circumferential flanges.

In another feature of the present invention, a stake includes a top end thereof that is dimensioned for receipt of the palm of a hand for pushing of the stake into the lawn. In this regard, the top end is rounded and may comprise a semi-spherical or spherical design.

In preferred embodiments of the kits, the artwork comprises an official emblem, mascot, or symbol of a sports team, such as a team logo of a college sports team, like the Georgia "G" or the Clemson tiger paw. In other preferred embodiments of the kit, the artwork comprises a team logo of a NASCAR racing team, like the Earnhardt "8". In other preferred embodiments, the artwork relates to particular sporting events, such as a weekly games or seasonal playoffs or championships.

Furthermore, each lawn stencil provided in the kit preferably includes a dimension no larger than about eight feet in height and about eight feet in length and, more preferably, a dimension no larger than about five feet in height and about five feet in length. Each lawn stencil also preferably comprises a flexible material having a width of about 2 to about 6 millimeters. The lawn stencils thereby are adapted for folding and convenient storage in a container intended for retail sale, storage, and transport by a consumer. Indeed, the kit preferably has a relatively small form factor that is dimensioned for point-of-sale display and purchase at retail stores by consumers.

In this respect, the kit preferably includes a container in which are disposed all of the lawn stencils, containers of paint, and stakes that are necessary for creating an artistic work on a lawn, which artistic work preferably is represented on the outside of the kit. The lawn stencils preferably are individually folded and disposed within the kit. Furthermore, the dimensions of such a kit preferably are about eleven inches in length, about ten and one-half inches in height, and about five and one-quarter inches in width. As will be appreciated, the width and length dimensions of the artwork to be created using the kit are substantially larger than the dimensions of the kit itself.

Method for Creating Artistic Work on Residential Lawn

A second aspect of the present invention broadly includes a method using the kit and/or components thereof in accordance with the first aspect in creating an artistic work on a residential lawn. This method includes: anchoring a stencil to a lawn; and applying a layer of paint in a desired pattern on the lawn by spraying paint over a pattern of openings in the lawn stencil. In this regard, the pattern of openings in the lawn stencil corresponds to one or more design elements of the artwork to be applied to the lawn.

In a feature of this aspect, the step of anchoring of the stencil to the lawn includes extending stakes through anchor openings of the lawn stencil. The stakes may be extended through the anchor openings by: first, laying the stencil upon the lawn, and then driving the stakes into the lawn through the anchor openings in the lawn stencil; and/or first driving the stakes into the lawn, and then sliding the lawn stencil over the stakes with the stakes extending through the anchor openings in the lawn stencil when positioning the stencil on the lawn. The stakes preferably are driven into the lawn by hand, and each stake preferably includes a top end thereof that is dimensioned for receipt of the palm of the hand for pushing of the stake into the lawn. In this regard, the top end is rounded and may comprise a semi-spherical or spherical design.

In still yet another feature of this aspect, the step of extending stakes through anchor openings of the lawn stencil includes extending a stake such that the stencil is retained between a circumferential flange of the stake and the lawn. The circumferential flange is dimensioned to block the stencil from slipping off of the top of the stake without stretching the stencil. In this regard, the lawn stencil preferably is resilient and recovers, at least to some extent, upon being stretched over the circumferential flange. A stake further may include one or more such circumferential flanges.

In another feature, the method includes: anchoring a first stencil to a lawn; applying a layer of paint of a first color in a first desired pattern on the lawn by spraying paint over a pattern of openings in the first lawn stencil; anchoring a second stencil to the lawn; and applying a layer of paint of a second color in a second desired pattern on the lawn by spraying paint over a pattern of openings in the second lawn stencil.

In this method, the pattern of openings in each lawn stencil corresponds to one or more design elements of the artwork to be applied to the lawn.

Additional lawn stencils and colors of paint also may be used in applying additional layers of paint in additional desired patterns in accordance with this method.

Furthermore, it will be appreciated form above that the alignment and orientation of each lawn stencil is important when applying the respective paint to create the respective design elements of the artwork, as the design elements work together to present the composite image representing the desired artwork.

Accordingly, in a feature of this aspect, the method includes positioning of the first lawn stencil and the later positioning of the second lawn stencil such that the indications of orientation are disposed in similar manner, e.g., each indication of orientation pointing in the same "UP" direction.

In a related feature of this aspect, the method includes positioning of the first and second alignment locations of the first lawn stencil in first and second fixed locations relative to the lawn when the first lawn stencil is sprayed with paint, and positioning of the first and second alignment locations of the second lawn stencil in the same first and second fixed locations relative to the lawn when the second lawn stencil is sprayed with paint. Furthermore, anchor openings serve as the alignment openings in preferred lawn stencils.

Method of Manufacturing Lawn Stencils

Yet another aspect of the present invention includes a method of manufacturing lawn stencils, which method accommodates mass production of the lawn stencils in an "assembly line" manner. In this regard, a lawn stencil preferably is manufactured from a planar sheet of film by cutting the desired pattern in the planar sheet of film using a high pressure stream of water, e.g., water jet.

Moreover, preferably a large plurality of the same lawn stencil, e.g., 200, are manufactured from a plurality planar sheets of film that are stacked on top of each other by cutting the desired pattern in all of the planar sheet of film using a high pressure stream of water that is capable of cutting through all of the stacked sheets. The film preferably is low density polypropylene (LEPP) or low density polyethylene (LDPE). It is believed that only water is required for cutting of the lawn stencils and that it would be unnecessary to include an abrasive component in the high pressure water stream for effective cutting of the lawn stencils.

In a feature of this aspect, connecting members or "gates" are formed integrally with each lawn stencil, wherein each gate extends across an opening of the pattern formed in the lawn stencil.

As noted above, proper alignment and orientation of each of the lawn stencils is important when applying the paint to create the respective design elements of the stencils, as the design elements work together to present the composite image representing the desired artwork.

Accordingly, in manufacturing each lawn stencil of a kit, a pattern in each stencil preferably is cut relative to each of the other patterns of the stencils of the kit such that proper alignment and/or overlap of the differing design elements resulting from the stencils results in the intended artwork is created. This correspondence may be achieved by cutting each pattern of each stencil of the kit relative to predetermined anchor openings of the stencil, wherein such a predetermined anchor opening of each stencil of the kit is designed to receive the same stake of the kit there through.

Furthermore, the alignment locations of the lawn stencils preferably comprise anchor openings for receiving the stakes for anchoring of the stencils to the lawn. Because these anchor openings of the first and second lawn stencils are known, a pattern of the first lawn stencil can be manufactured relative to the alignment locations of the first lawn stencil, and a pattern of the second lawn stencil can be manufactured relative to the alignment locations of the second lawn stencil, thereby fixing the alignment of the patterns of the two lawn stencils relative to one another.

In a related feature of this aspect, an indication of orientation preferably is cut in, or otherwise formed in or created on, each of a plurality of lawn stencils of a kit, whereby each lawn stencil of the plurality may be properly oriented with regard to the other lawn stencils of the plurality.

As a result of the ability to mass produce the lawn stencils, the lawn stencils and related kits are relatively inexpensive to produce and can be offered for sale at a price conducive to impulse purchases at or near point-of-sale locations, such as by the counters in hardware stores or other stores where home improvement or do-it-yourself products are sold.

In addition to the aforementioned aspects and features of the present invention, the present invention further includes the various possible combinations of such aspects and features.

One or more preferred embodiments of the present invention now will be described in detail with reference to the accompanying drawings.

DETAILED DESCRIPTION

Figure 1:
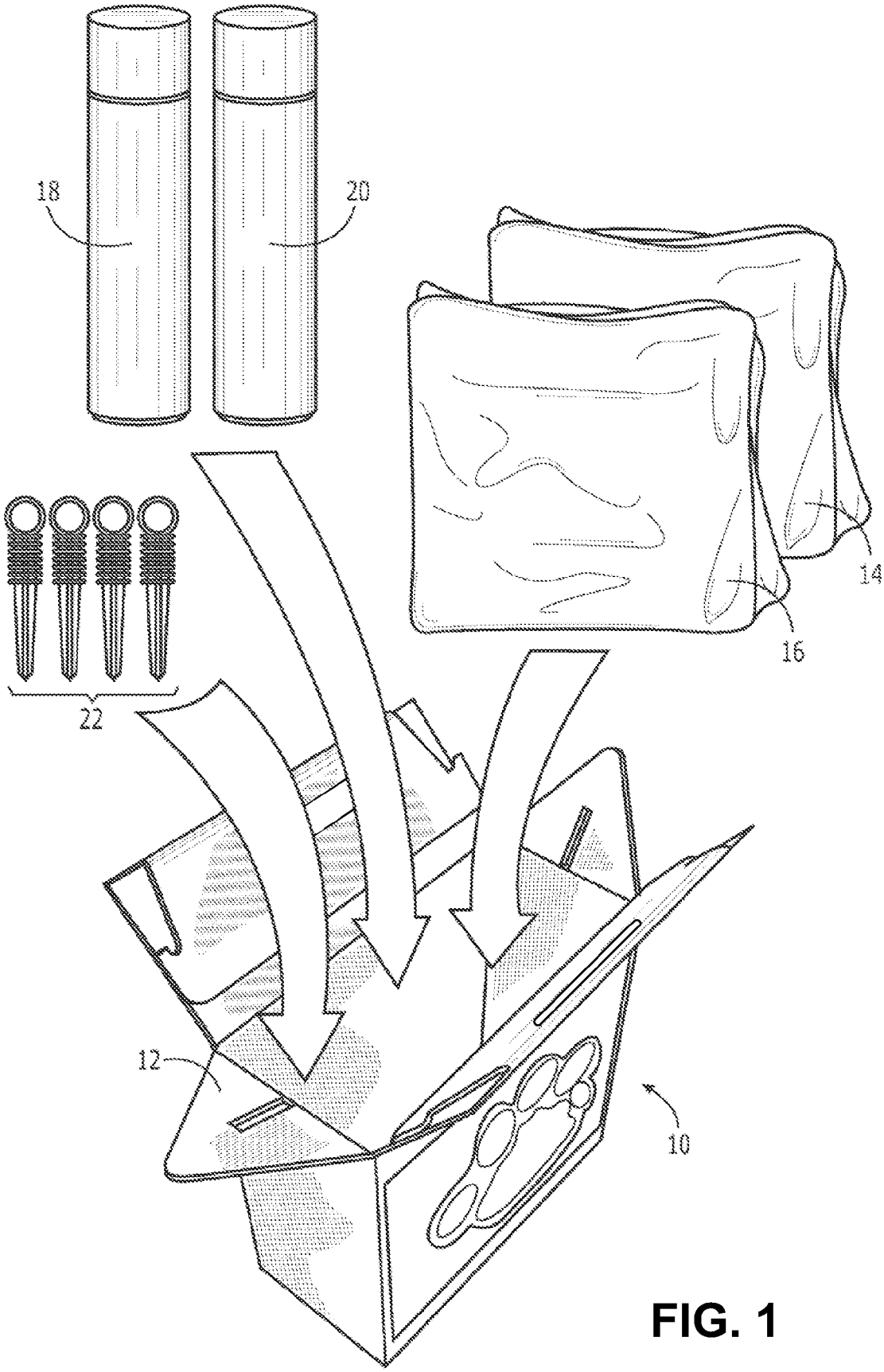
FIG. 1 is a perspective view of the components of a preferred embodiment of a kit.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Preferred Kits for Creating Artistic Work on Residential Lawn

Referring now to FIG. 1, the components of a preferred embodiment 10 of a kit in accordance with the present invention are illustrated. The illustrated kit comprises a kit for creating the Clemson tiger paw on a residential lawn.

The kit 10 includes: a container comprising a box 12; a first lawn stencil 14; a second lawn stencil 16; a first container 18 of white paint; a second container 20 of orange paint; and a plurality of stakes 22. While the paint preferably is not permanent, the paint may be permanent, especially for use by fanatical sports fans.

The box 12 preferably constitutes the retail packaging in which the kit is sold and includes a graphical representation thereon of the artwork that can be created using the kit. The graphical representation on the box 12 in FIG. 1 comprises the Clemson tiger paw. Easy-to-follow instructions for using the components of the kit to create the Clemson tiger paw also may be included on the exterior of the retail packaging and/or within the box.

Each container of paint 18,20 preferably comprises aerosol turf paint, which is made and intended for use on grass and does not chemically harm the grass. Such field paint is commonly available in various different colors and used, for example, in striping a sports field. Each container preferably includes a sufficient supply of paint to cover twenty-five square feet of grass, which is more than sufficient for applying a design element using, e.g., a stencil that is about five feet in length and about five feet in width.

The plurality of stakes 22 are sufficient in number to securely anchor each of the lawn stencils to a lawn so that the lawn stencil does not substantially move while paint is being sprayed over the lawn stencil. An exemplary number of stakes is four, with each stake being used to secure one of four corners of an exemplary rectangular stencil.

Each of the lawn stencils 14,16 is disposed within the box 12 in a folded configuration as shown in FIG. 1. Alternatively, a lawn stencil may be disposed within the box of the kit in a rolled configuration (not shown).

Figure 2:
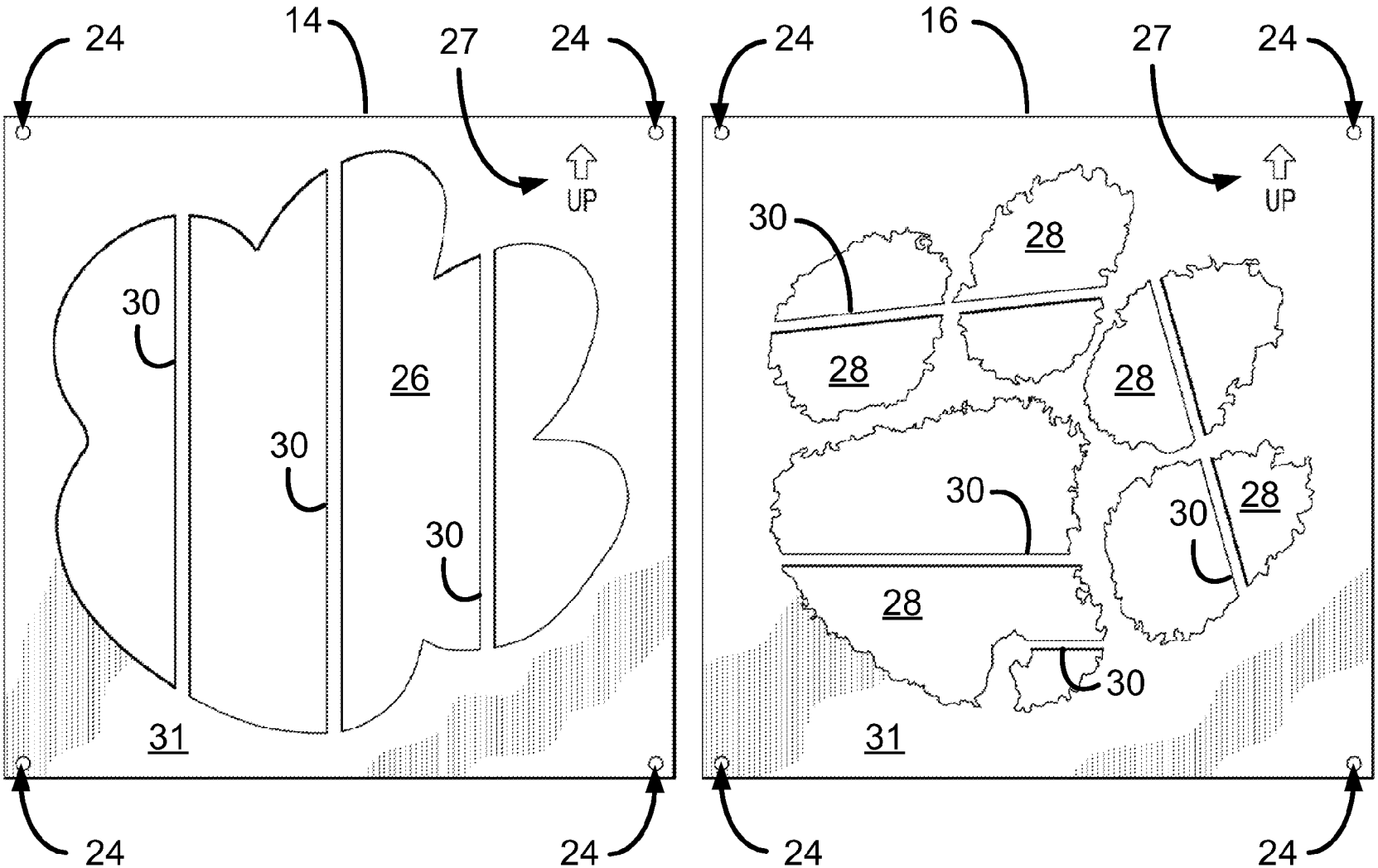
FIG. 2 is a top plan view of the lawn stencils of the kit of FIG. 1.

Each lawn stencil 14,16 is shown in its unfolded configuration in FIG. 2 and is, for example, rectangular in shape. More particularly, each lawn stencil 14,16 preferably is about five feet in length and about five feet in width, with each of the two lawn stencils 14,16 shown in FIG. 2 spanning an area of about twenty-five square feet.

Each lawn stencil 14,16 further is preferably made of between 2 millimeter and 6 millimeter construction grade plastic, such as low density polypropylene (LDPP) or low density polyethylene (LDPE). Use of LDPP or LDPE makes the lawn stencil easy to fold and unfold while providing a sufficient degree of durability that enables several uses of the lawn stencil over time.

Also as illustrated in FIG. 2, each lawn stencil 14,16 preferably includes four anchor openings 24 in its four corners. Each anchor opening is dimensioned to receive there through one of the plurality of stakes 22 for fastening of the lawn stencil to the lawn. The stakes 22 are further described below with reference to FIG. 5.

The orientation and alignment of each lawn stencil when fastened to the ground using stakes is important when creating the intended artwork.

Accordingly, each lawn stencil of a kit should include an indication of orientation for properly orienting the lawn stencil relative to each lawn stencil of the kit during creating of the artwork. In the exemplary kit 10, each lawn stencil 14,16 is provided with an orientation mark "UP" and an arrow that constitute the indication 27 of orientation, which are located in the upper right-hand corner of the lawn stencil for proper positioning on the ground.

Each lawn stencil further includes alignment openings for proper alignment of the lawn stencil relative to other lawn stencils. In the exemplary kit 10, the anchor openings 24 serve as the alignment openings.

Each lawn stencil 14,16 includes a pattern of openings therein that collectively correspond to one or more design elements of the artwork to be applied to the lawn using the paint. The lawn stencil 14 includes a pattern of a single openings 26 that represents an overall outline of the Clemson tiger paw, and the lawn stencil 16 includes a pattern of five openings 28 that represents individual outlines of the five pads of the Clemson tiger paw.

As will be appreciated from review of FIG. 2, the openings of the pattern in each lawn stencil 14,16 are particularly large and represent a large portion of the area of the respective lawn stencil. In order to maintain the structural integrity of the stencil, and in order to distribute tension in the lawn stencil so that the lawn stencil lies taut and flat when fastened to the ground using the stakes, each lawn stencil 14,16 preferably includes connecting members or "gates" 30, each of which extends across an opening of the pattern of the lawn stencil.

As will be appreciated, these gates 30 serve to distribute tension through each lawn stencil 14,16 so that each lawn stencil lies flat and the design elements created using the lawn stencil are not distorted when paint is sprayed over the lawn stencil. In particular, the gates 30 convey tension through the middle portions of the lawn stencils from one side to the other. Without the gates 30, the tension generally would be conveyed along the outer periphery of the lawn stencil causing the lawn stencil to warp or distort when stretched taut upon the ground.

Moreover, as discussed below with regard to the preferred manufacturing method of lawn stencils, the gates preferably are formed as an integral part of the lawn stencil by cutting a plastic film 31 from which each lawn stencil is formed to include not only the respective pattern of openings therein but also the gates 30 extending there across. The gates thus are constructed from the same plastic film 31 from which the lawn stencil is constructed. Alternatively, the gates are attached to the stencil after cutting of the stencil from the plastic film using, for example, an adhesive, cohesive, or other means of bonding, including welding for fusing.

Figure 3:
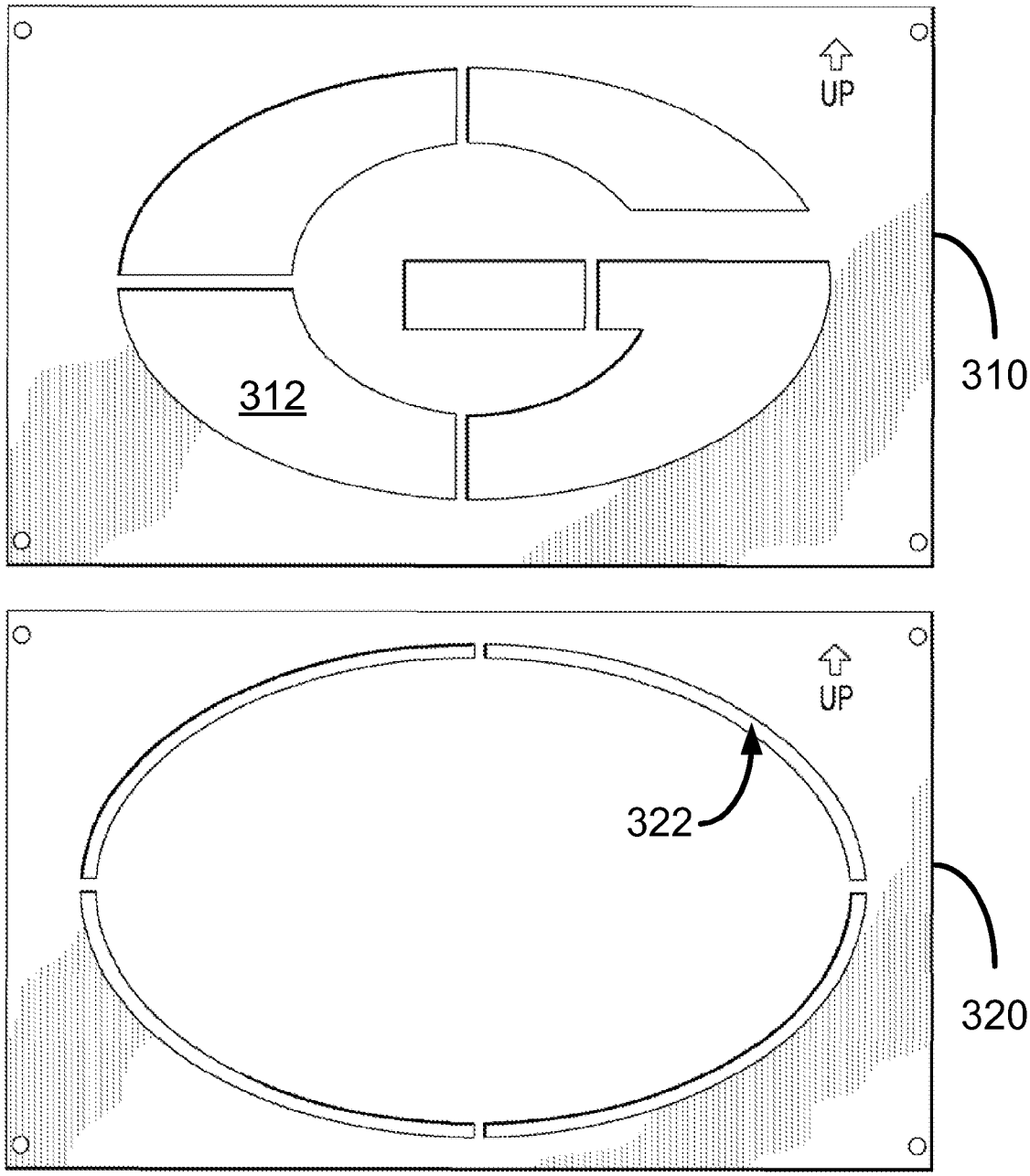
FIG. 3 is a top plan view of lawn stencils for creating the Georgia "G".
Figure 4:
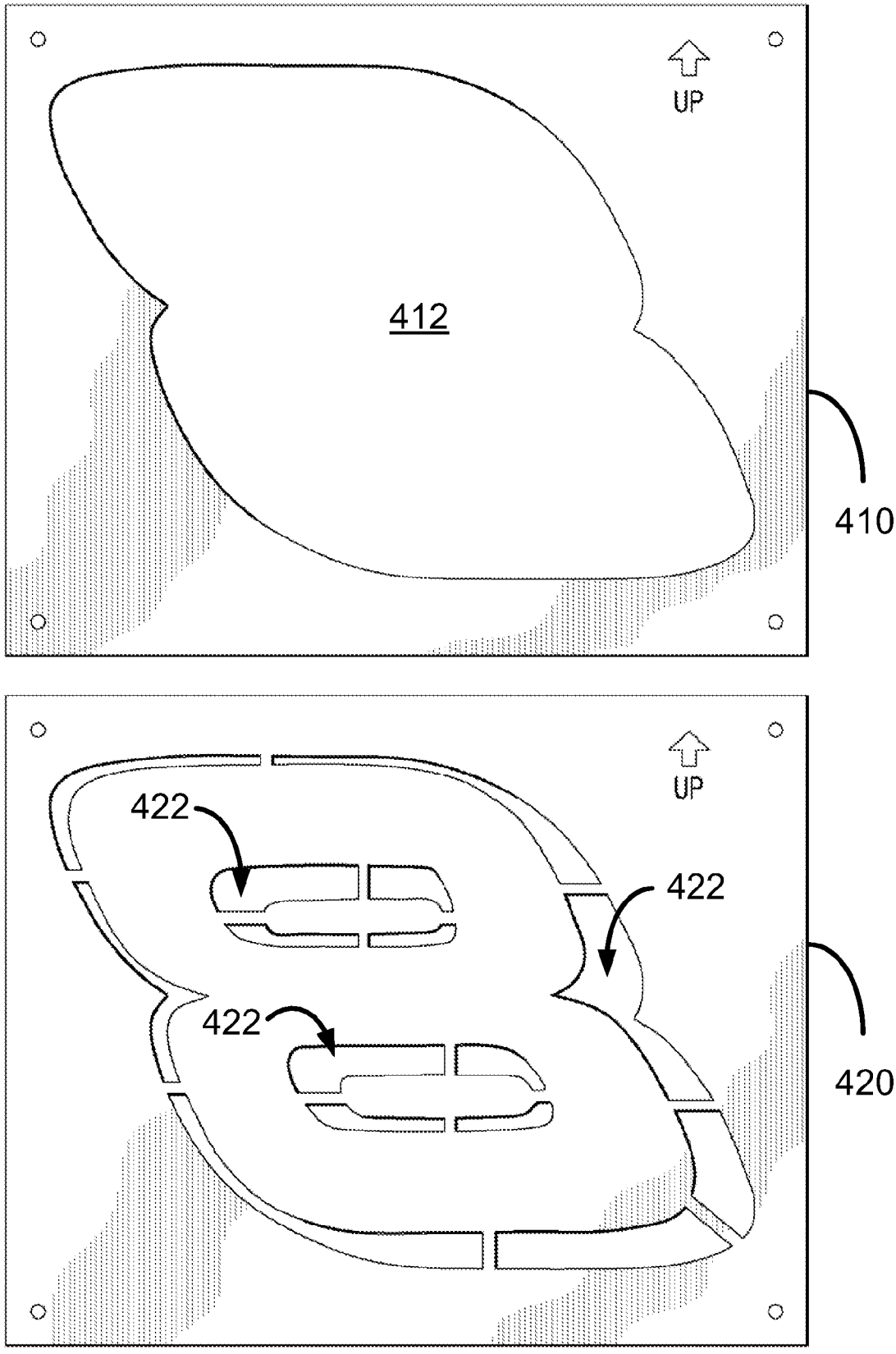
FIG. 4 is a top plan view of lawn stencils for creating the "Earnhardt 8".

Additional lawn stencils similar in construction to the lawn stencils 14,16 of FIG. 2 are illustrated in FIGS. 3 and 4.

In particular, the differences between these lawn stencils 14,16 of FIG. 2 and those of FIG. 3 are that the lawn stencils 310,320 of FIG. 3 are utilized to create the Georgia "G", with the lawn stencil 310 including a pattern of a single opening 312 with four gates, and with the lawn stencil 320 including a pattern of a single opening 322 with four gates.

The differences between the lawn stencils 14,16 of FIG. 2 and those of FIG. 4 are that the lawn stencils 410,420 of FIG. 4 are utilized to create the Earnhardt "8", with the lawn stencil 410 including a pattern of a single opening 412 with no gates, and with the lawn stencil 420 including a pattern of three openings 422 with fifteen gates.

Figure 5:
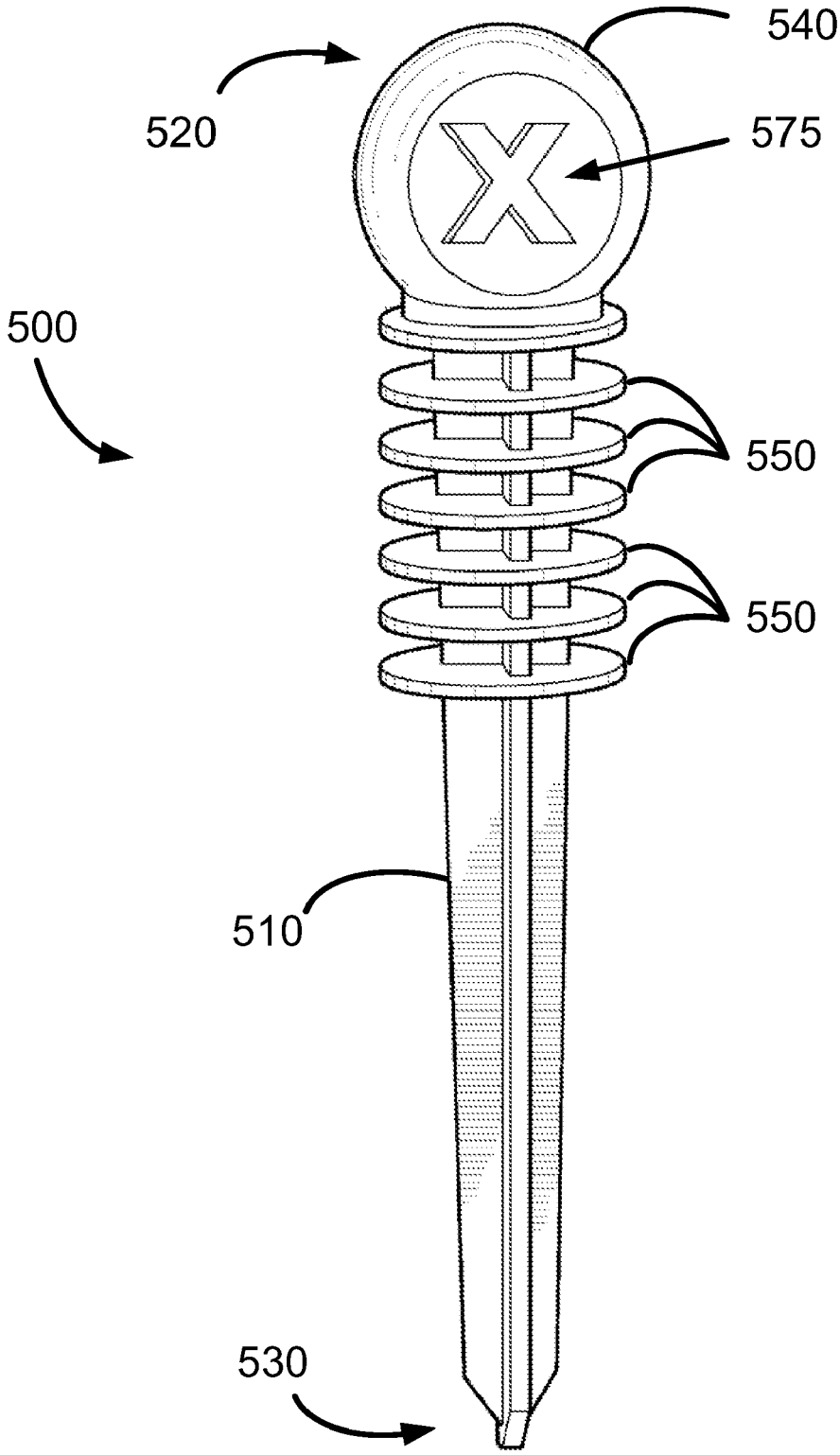
FIG. 5 is side elevational view of a preferred embodiment of a stake.

Referring now to FIG. 5, an exemplary stake 500 of the plurality of stakes 22 of the kit 12 of FIG. 1 is illustrated. The stake 500 has an elongated shaft 510 comprising a proximal portion 520 and a distal portion 530. The proximal portion 520 comprises a rounded head 540 contoured to be comfortably received within the palm of a hand when the stake 500 is driven into the ground. The distal portion 530 is pointed and includes a shape for easy insertion of the stake 500 into the ground.

A number of circumferential flanges 550 also are disposed along the shaft 510 in proximity to the proximal portion 520. Each circumferential flange preferably is dimensioned such that, upon extension of the stake through an anchor opening of a lawn stencil, the stencil is retained between the circumferential flange and another circumferential flange or, in the case of the most distal circumferential flange, between such circumferential flange and the lawn. The circumferential flanges serve to keep the lawn stencil from lifting up off of the lawn when, for example, the stencil is blown by the wind. Two or more lawn stencils also may be retained by a single stake, with each lawn stencil retained by a different one of the circumferential flanges.

The stake 500 preferably includes a bright color, such as bright orange, which contrasts well with green grass. The stake 500 also preferably includes an area 575 at the proximal portion 520 whereupon a trademark may be placed for identifying the source of the lawn stencils and kits.

Preferred Methods for Creating Artwork on a Lawn

A preferred method of creating an artistic work of art on a lawn includes anchoring a stencil to a lawn and applying a layer of paint in a desired pattern on the lawn by spraying paint over a pattern of one or more openings in the lawn stencil. In this regard, the pattern of one or more openings in the lawn stencil corresponds to one or more design elements of the artwork to be applied to the lawn.

For example, with regard to the exemplary kit 10 of FIG. 1 for creating a Clemson tiger paw in a residential lawn, the lawn stencil 14 is unfolded and positioned over the desired area of the lawn where the artwork is to be created. Four stakes 22 then are driven into the ground, each through a respective anchor opening 24 of the lawn stencil 14.

The stakes preferably are driven into the lawn by hand, and each stake preferably includes a top end thereof that is dimensioned for receipt of the palm of the hand for pushing of the stake into the lawn. In this regard, the top end is rounded and may comprise a semi-spherical or spherical design.

The container 18 of white paint then is utilized to spray white paint over the lawn stencil 14 thereby forming an outline of the overall tiger paw on the lawn via the opening 26. During the paint spraying, the lawn stencil 14 should be adequately stretched or taut so that the lawn stencil 14 lies substantially flat on the lawn.

During this process, the indication 27 of orientation on the first lawn stencil 14 is noted by the person creating the artwork.

The lawn stencil 14 preferably is left on the ground for approximately 5 to 7 minutes following paint spraying in order to allow for the paint to dry, after which the lawn stencil 14 is removed while the stakes are left in ground. In this respect, each of the four corners of the lawn stencil 14 preferably are stretched over the circumferential flanges 550 of the stakes 22.

Additionally, following the removal of the first lawn stencil 14, the container 18 of white paint is utilized to touch-up the outlines of the pattern of the single opening 26 and to complete and fill-in the area of the outline that has been formed in the lawn using the first lawn stencil 14.

Thereafter, the second lawn stencil 16 is placed in overlapping disposition over the area of the lawn that was covered by the first lawn stencil 14 by stretching the corners of the second lawn stencil 16 over the stakes 22.

Specifically, the stakes are extended through the anchor openings 24 of the second lawn stencil 16, which also thereby serve as the alignment openings of the lawn stencil. The stakes 22 are extended through the anchor openings 24 without withdrawing the stakes 22 from the ground, thereby insuring proper alignment and overlap of the second lawn stencil 16 over the design elements that were applied using the first lawn stencil 14.

Further to insure proper orientation of the second lawn stencil 16 on the lawn, the indication 27 of orientation of the second stencil 16 also is disposed in the same manner as the indication 27 of orientation of the first lawn stencil 14 was disposed, e.g., such that both pointed in the same direction "UP".

Following the proper alignment and orientation of the second lawn stencil 16 on the lawn, the second container 20 of orange paint then is utilized to spray orange paint over the second lawn stencil 16 thereby forming outlines of five individual pads of the tiger paw on the lawn via the openings 28. During the paint spraying, the second lawn stencil 16 should be adequately stretched or taut so that the lawn stencil 16 lies substantially flat on the lawn.

The second lawn stencil 16 preferably is left on the ground for approximately 5 to 7 minutes following paint spraying in order to allow for the paint to dry, after which the second lawn stencil 16 is removed.

Following the removal of the second lawn stencil 16, the container 20 of orange paint is utilized to touch-up the outlines of the pattern of the five openings 28 and to complete and fill-in the area of each such outline that has been formed in the lawn using the second lawn stencil 16.

Additionally, the stakes 22 further are removed, as the second lawn stencil 16 is the last lawn stencil of the kit 10 that is used in creating the artwork.

The lawn stencils 14,16, the two containers 18,20 of paint, and the stakes 22 are then placed back into the box 12 for storage of the kit 10 until the next time the Clemson tiger paw is to be created in the lawn. In this regard, the lawn stencils 14,16 preferably are reusable.

While the aforementioned method has been described with reference to two lawn stencils and two colors of paint, more than two colors and/or two lawn stencils can be used in accordance with the present invention, depending on the complexity of the design of the artwork to be created in the lawn.

Moreover, preferred dimensions have been set forth, but different and various sizes of the lawn stencils may be utilized in accordance with kits of the present invention, so long as the components required to create the artistic works fit within the kits as shown, e.g., in FIG. 1.

A subsequent lawn stencil also may be positioned for application of one or more design elements of the artwork to the lawn without first removing a precedent lawn stencil, in which case the subsequent lawn stencil is positioned over the precedent lawn stencil. Thus, for example, the area of the outline of the pattern of the opening in the lawn stencil 14 may be filled-in with white paint and then the second lawn stencil 16 positioned over the first lawn stencil 14 for applying the outlines of the pads of the tiger paw with orange paint without first removing the first lawn stencil 14. In this regard, the multiple circumferential flanges 550 of the stakes 22 retains the corners of both lawn stencils 14,16 during the application of the design elements of the artistic work represented by the pattern of openings in the second lawn stencil 16.

The artistic work, while preferably relating to a team logo, alternatively may relate to a season or holiday. For example, in October, the artistic work may comprise a "jack-o-lantern", and in December, the artistic work may comprise a "Christmas Tree", "Santa" or "Frosty the Snowman."

Preferred Methods for Manufacturing Lawn Stencil Kits

The lawn stencils of the preferred kits of the present invention preferably are manufactured using water jet cutting, which is preferred over other alternative manufacturing methods, such as laser cutting, which is too hot, or blade cutting, which does not accommodate well the cutting of layered sheets of plastic.

Such a manufacturing method accommodates mass production of the lawn stencils in an "assembly line" manner. In this regard, a lawn stencil preferably is manufactured from a planar sheet of film by cutting the desired pattern in the planar sheet of film using a high pressure stream of water, e.g., water jet.

Water jet cutting machines are well-known, including those that include abrasive and non-abrasive water jet cutting. For example, a water jet cutting machine is disclosed and described in U.S. Pat. No. 4,728,379. As water jet cutting machines are well-known, such machines are not further described herein. Indeed, an aspect of the present invention only relates to use of such machines in manufacturing preferred lawn stencils of the present invention, and not to any particular detail of the water cutting machines themselves.

Accordingly, in the preferred manufacturing process, preferably a large plurality of the same lawn stencil, e.g., 200 stencils, are manufactured from a plurality planar sheets of film that are stacked on top of each other by cutting the desired pattern in all of the planar sheet of film using a high pressure stream of water that is capable of cutting through all of the stacked sheets. During this cutting process, gates also preferably are integrally formed as part of the lawn stencil.

The film preferably is low density polypropylene (LEPP) or low density polyethylene (LDPE). It is believed that only water is required for cutting of the lawn stencils and that it would be unnecessary to include an abrasive component in the high pressure water stream for effective cutting of the lawn stencils.

As noted above, proper alignment and orientation of each of the lawn stencils is important when applying the paint to create the respective design elements of the stencils, as the design elements work together to present the composite image representing the desired artwork.

Accordingly, in manufacturing a lawn stencil for a particular kit, a pattern preferably is cut relative to each of the other patterns of the lawn stencils of that kit such that proper alignment and/or overlap of the differing design elements resulting from the lawn stencils results in the intended artwork. To achieve this correspondence, the method preferably includes the cutting of each pattern in each stencil of the kit relative to predetermined anchor openings of the stencil, wherein a predetermined anchor opening of each stencil of the kit is designed to receive the same stake of the kit there through.

In this regard, these predetermined anchor openings serve as alignment locations of the lawn stencils of the kit. Because these anchor openings of the lawn stencils of the kit are known at the time of manufacture, a pattern of the first lawn stencil can be cut relative to the anchor openings of the first lawn stencil, and a pattern of the second lawn stencil can be cut relative to the anchor openings of the second lawn stencil, thereby fixing the alignment of the patterns of the two lawn stencils relative to one another.

In a related feature of this aspect, an indication of orientation also preferably is cut in each of the lawn stencils of the kit, whereby each lawn stencil of the kit may be properly oriented with regard to the other lawn stencils of the kit by similar disposition of the indications of orientation. Thus, as shown in the drawings, for example, each lawn stencil includes an "UP" arrow cut therein, which comprises the indication of orientation of the lawn stencil.

As a result of the ability to mass produce the lawn stencils, the lawn stencils and related kits are relatively inexpensive to produce and can be offered for sale at a price conducive to impulse purchases at or near point-of-sale locations, such as by the counters in hardware stores or other stores where home improvement or do-it-yourself products are sold.

The Illustrations of FIGS. 6-18

Figure 6:
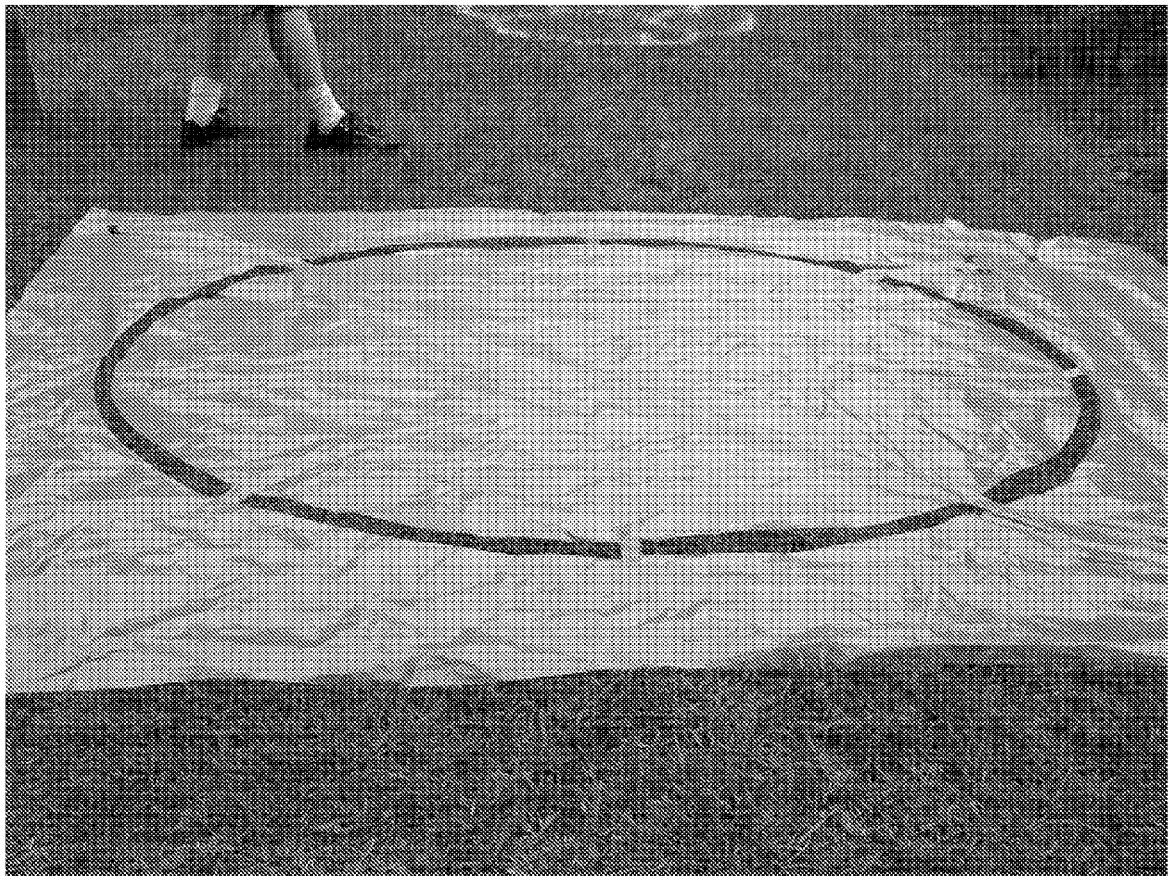
FIG. 6 illustrates a step in a process of creating an artistic work on a lawn in accordance with an embodiment of the present invention, wherein a first lawn stencil has been anchored to the lawn using a plurality of stakes.
Figure 7:
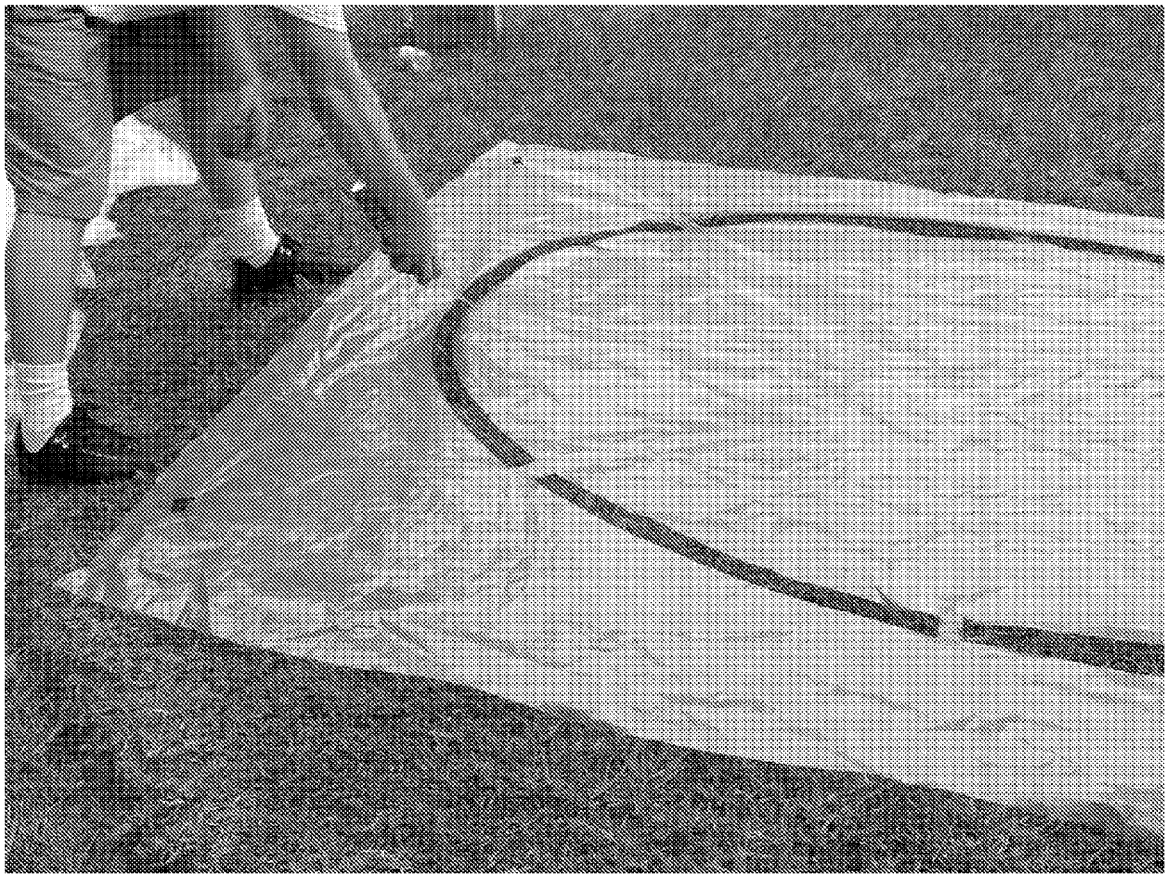
FIG. 7 illustrates a step in a process of creating an artistic work on a lawn in accordance with an embodiment of the present invention, wherein paint of a first color is applied to the lawn using the first lawn stencil.
Figure 8:
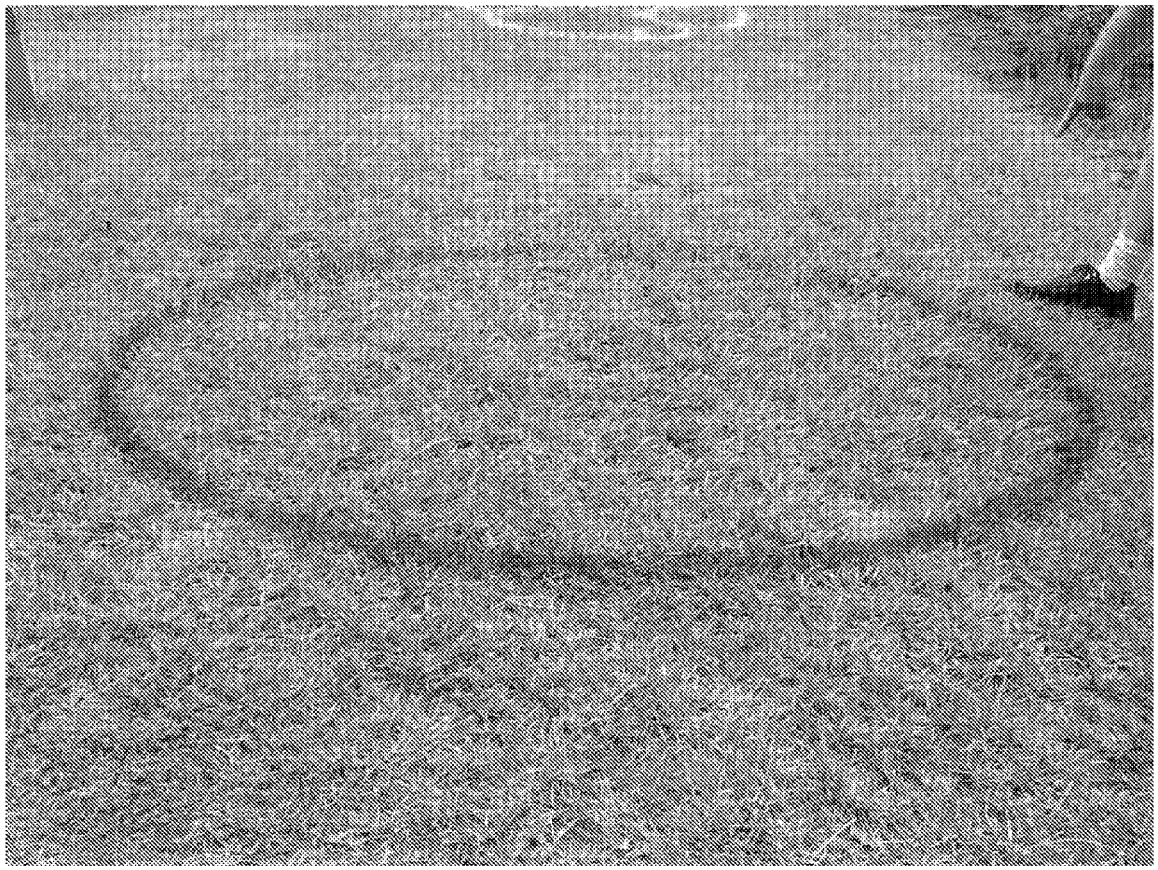
FIG. 8 illustrates a step in a process of creating an artistic work on a lawn in accordance with an embodiment of the present invention, wherein a circular outline has been created by applying the first color to the lawn using the first lawn stencil as illustrated in FIG. 7.

FIGS. 6-14 illustrates steps in a process of creating an artistic work on a lawn in accordance with an embodiment of the present invention. In FIG. 6, a first lawn stencil has been anchored to the lawn using a plurality of stakes, and in FIG. 7 red paint is applied to the lawn using the first lawn stencil. A red circular outline is thereby created, as shown in FIG. 8.

Figure 9:
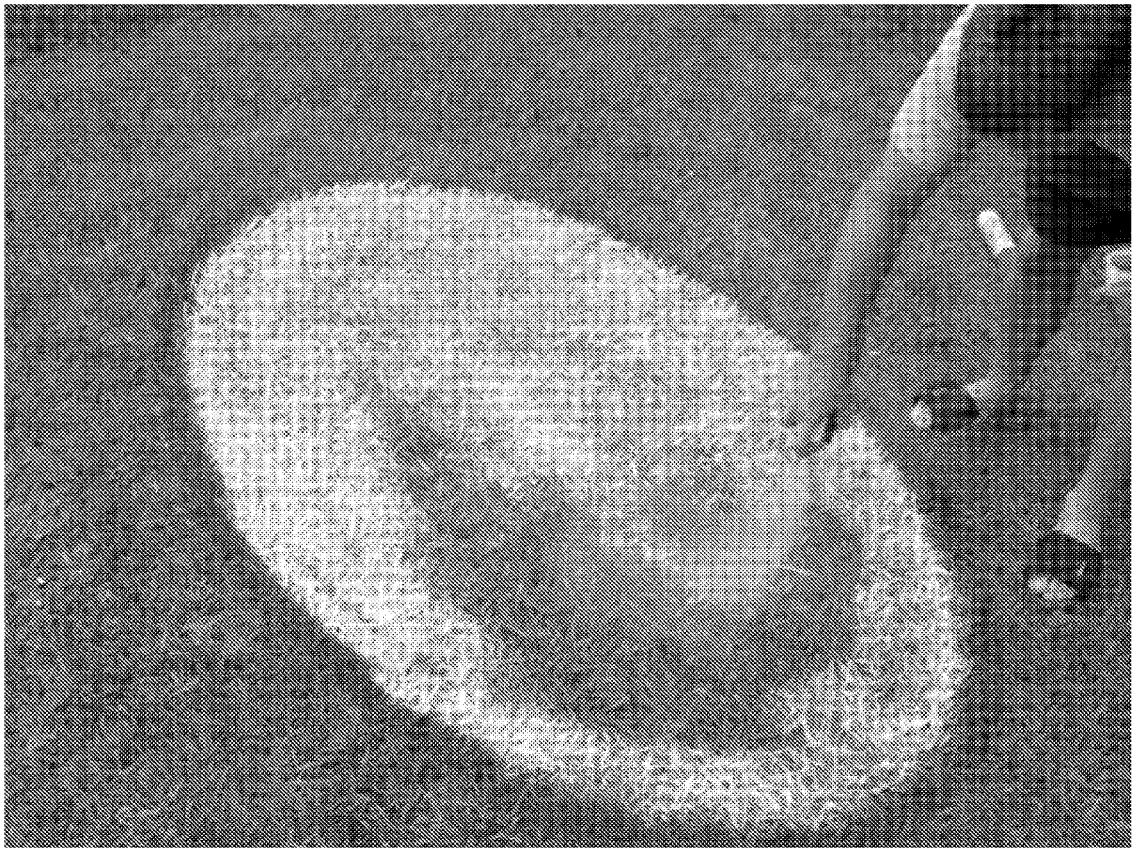
FIG. 9 illustrates a step in a process of creating an artistic work on a lawn in accordance with an embodiment of the present invention, wherein the circular outline of FIG. 8 is being filled in using paint of a second color.
Figure 10:
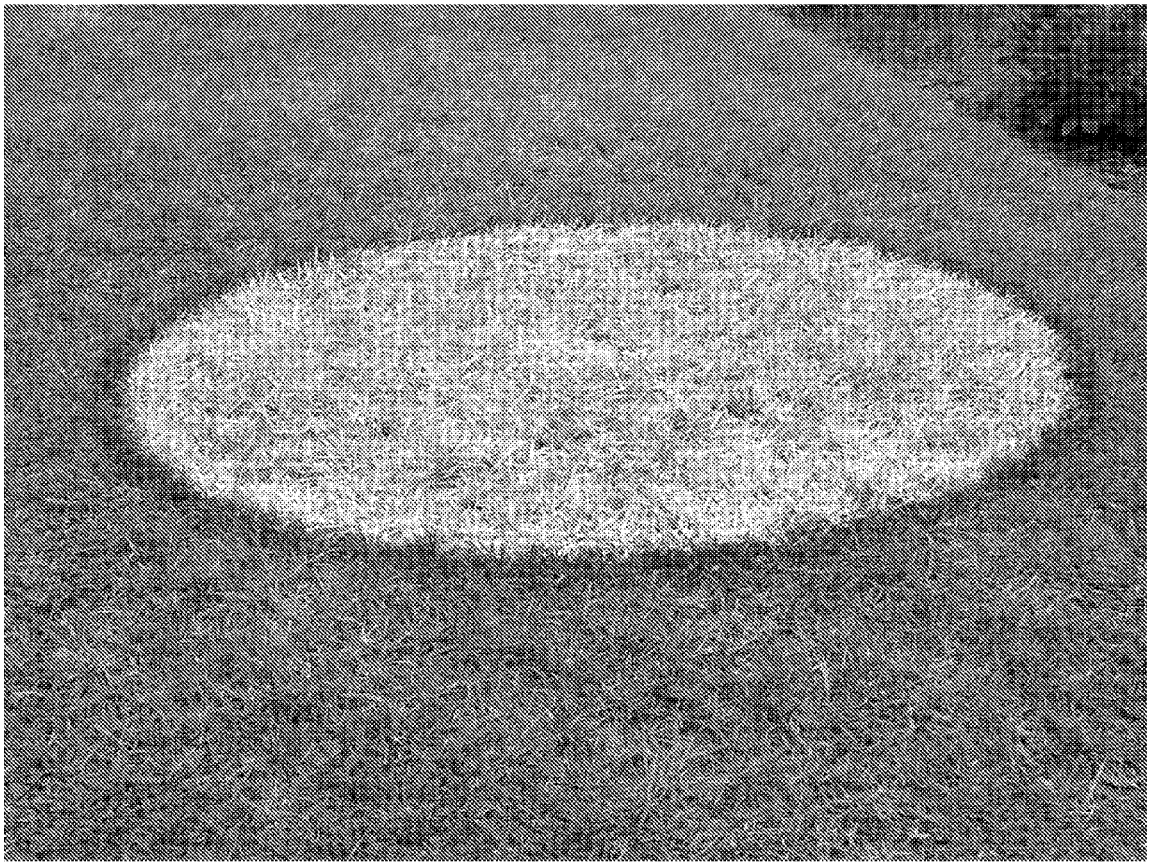
FIG. 10 illustrates a step in a process of creating an artistic work on a lawn in accordance with an embodiment of the present invention, wherein the circular outline of FIG. 8 has been filled in using the paint of the second color.

In FIG. 9 the red circular outline is shown being filled in using white paint and, in FIG. 10, the circular outline is shown completely filled using the white paint.

Figure 11:
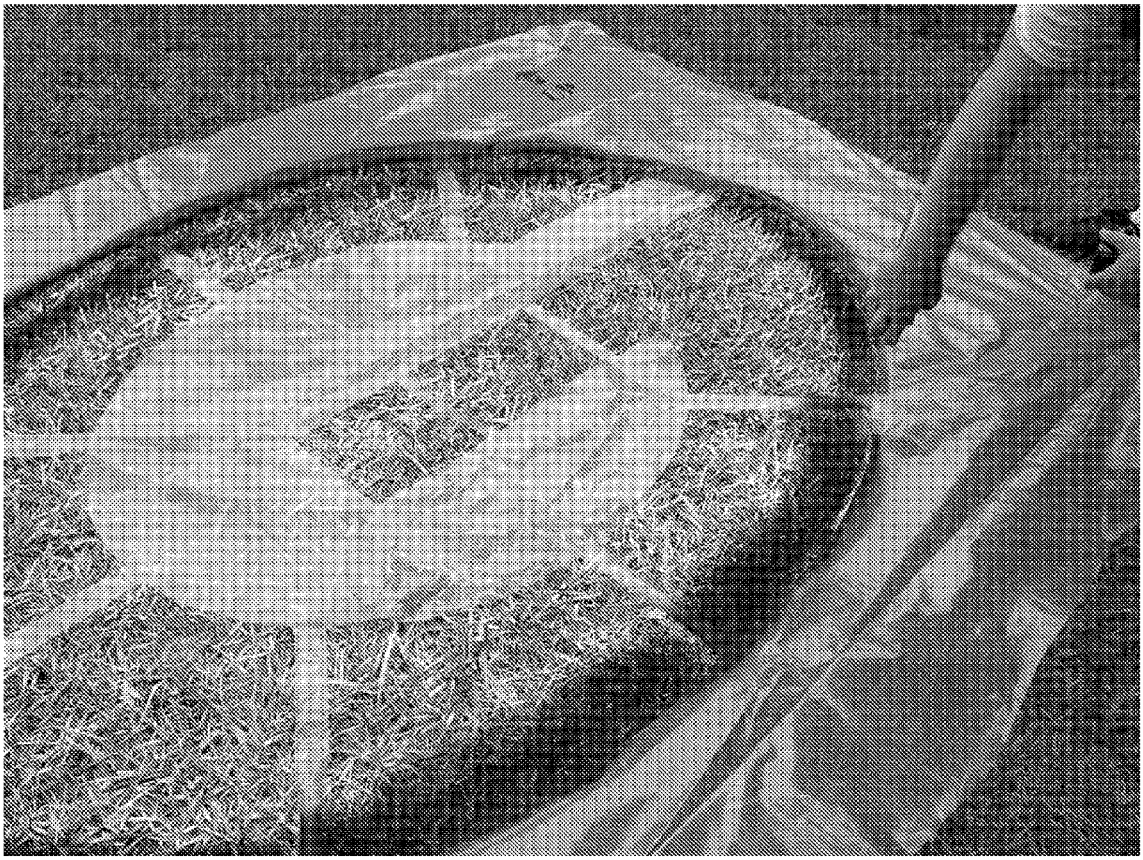
FIG. 11 illustrates a step in a process of creating an artistic work on a lawn in accordance with an embodiment of the present invention, wherein a second lawn stencil has been anchored over the area of the lawn and wherein paint of a third color is being applied to the lawn using the second lawn stencil.
Figure 12:
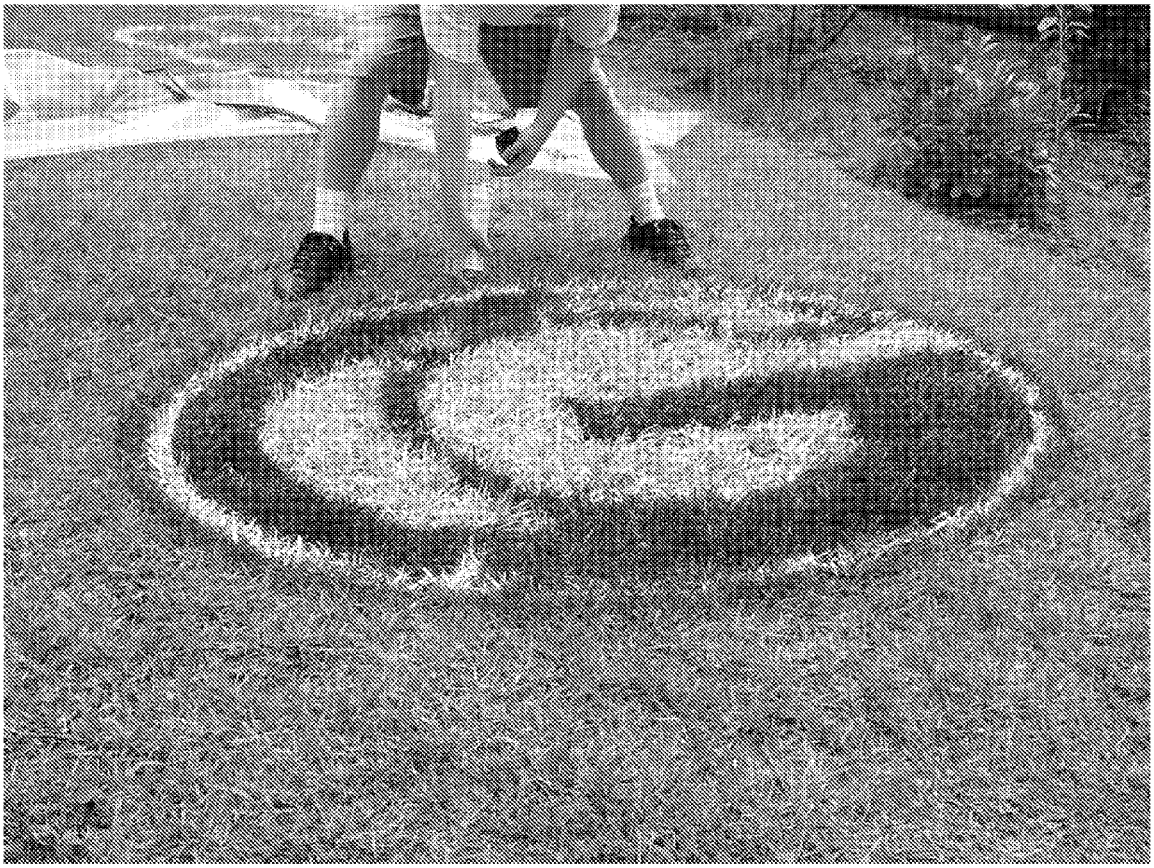
FIG. 12 illustrates a step in a process of creating an artistic work on a lawn in accordance with an embodiment of the present invention, wherein the second lawn stencil has been removed and a G-shaped outline, created by applying the third color to the lawn using the second lawn stencil, is being filled-in with the paint of the third color.

A second lawn stencil has been anchored over the area of the lawn in FIG. 11 and black paint is shown being applied to the lawn using the second lawn stencil. A black G-shaped outline is thereby created and, as shown in FIG. 12, the G-shaped outline is filled-in with the black paint.

Figure 13:
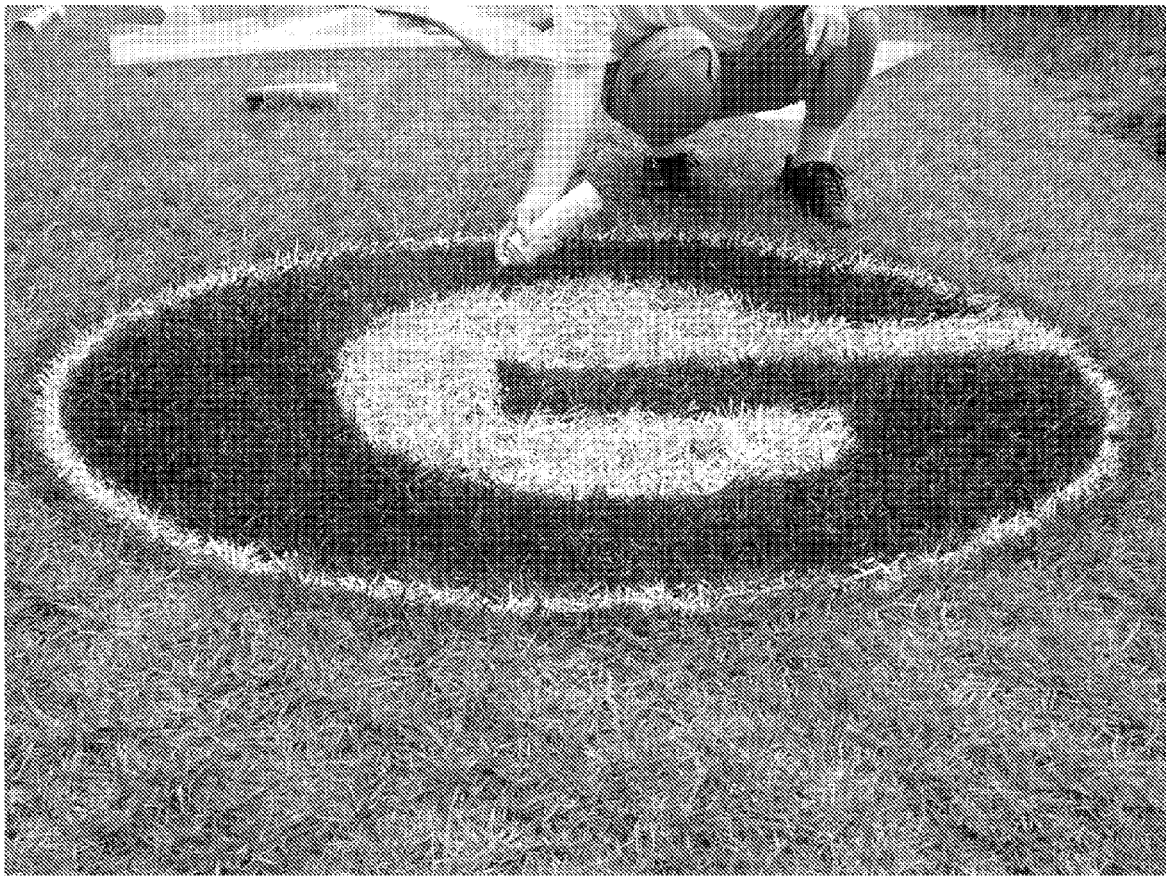
FIGS. 13 and 14 illustrates a step in a process of creating an artistic work on a lawn in accordance with an embodiment of the present invention, wherein touch-up work is performed to complete the creation of the artistic work.
Figure 14:
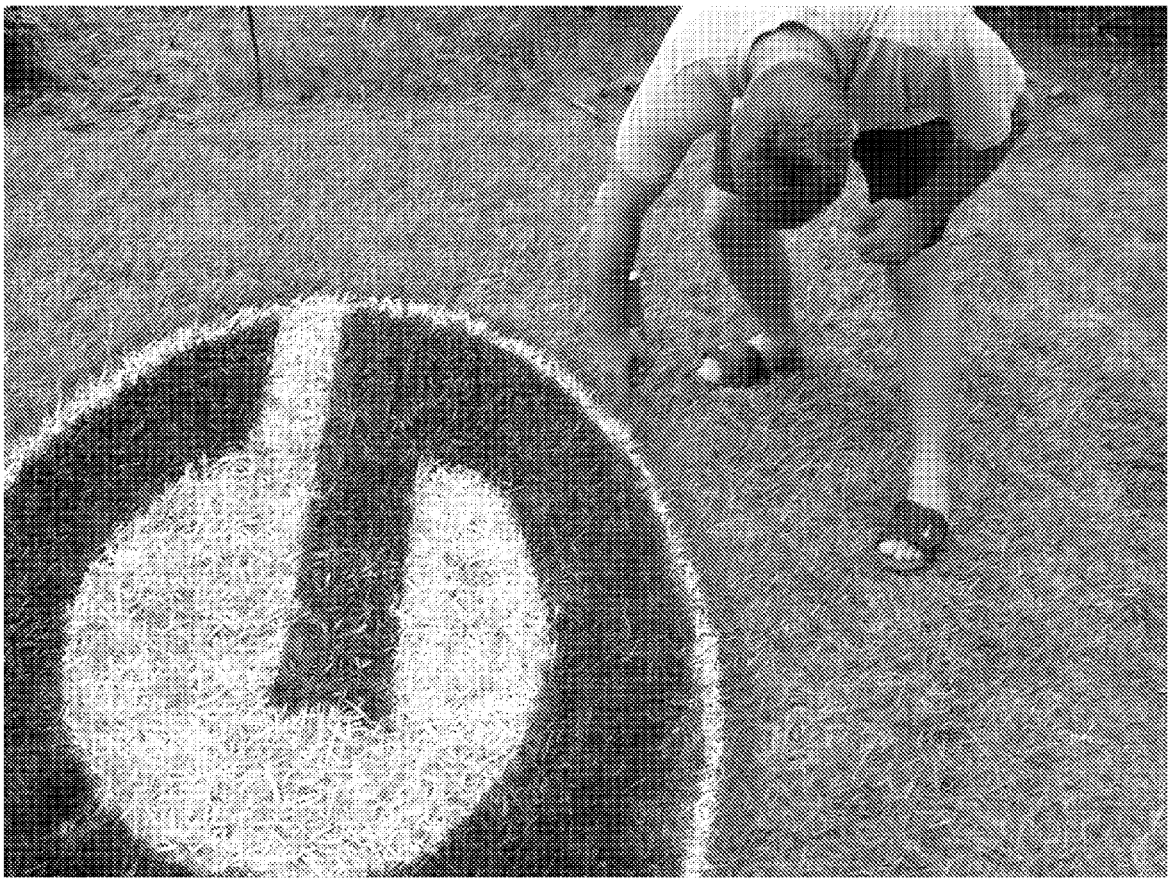

The artistic work is completed by touching it up as needed using the paint, as shown in FIGS. 13 and 14.

Figure 15:
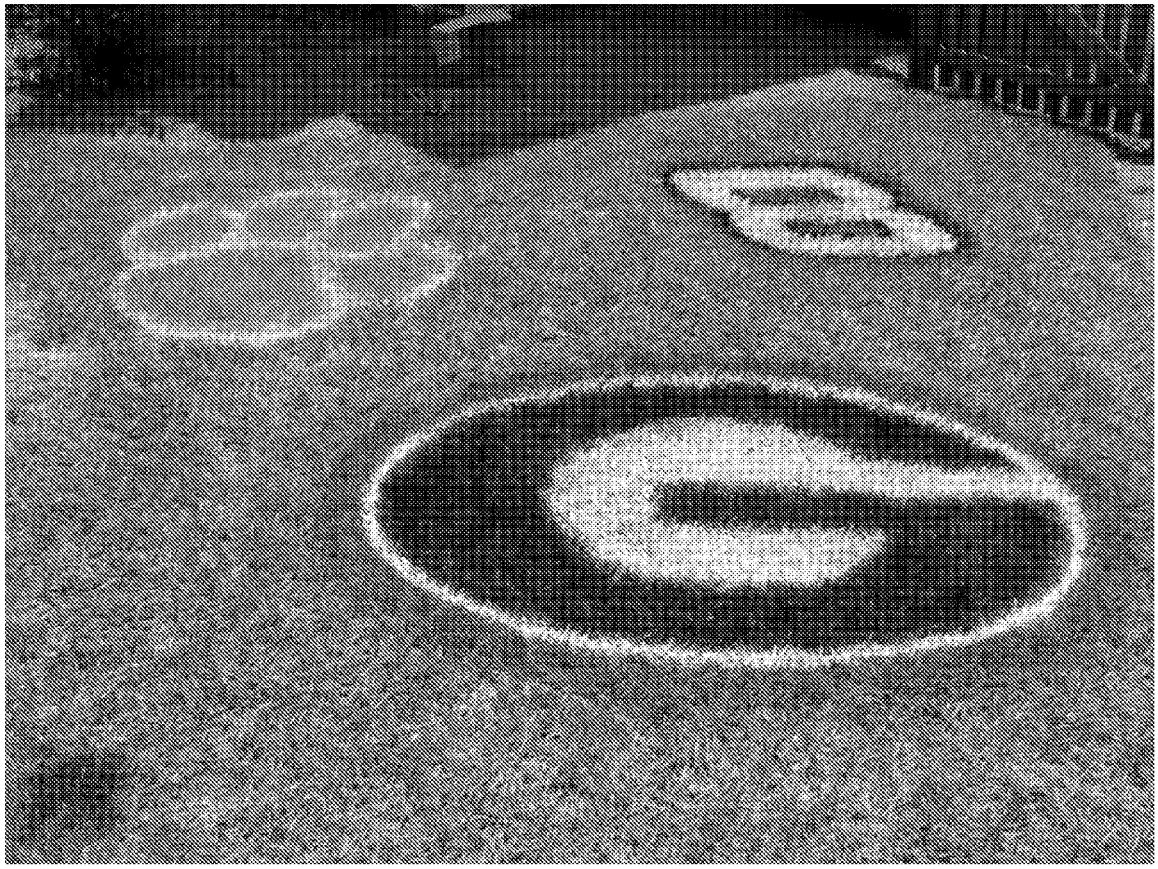
FIG. 15 illustrates three artistic works that have been created on a lawn using methods in accordance embodiments of with the present invention.

FIG. 15 illustrates three artistic works that have been created on a lawn using methods in accordance embodiments of with the present invention.

Figure 16:
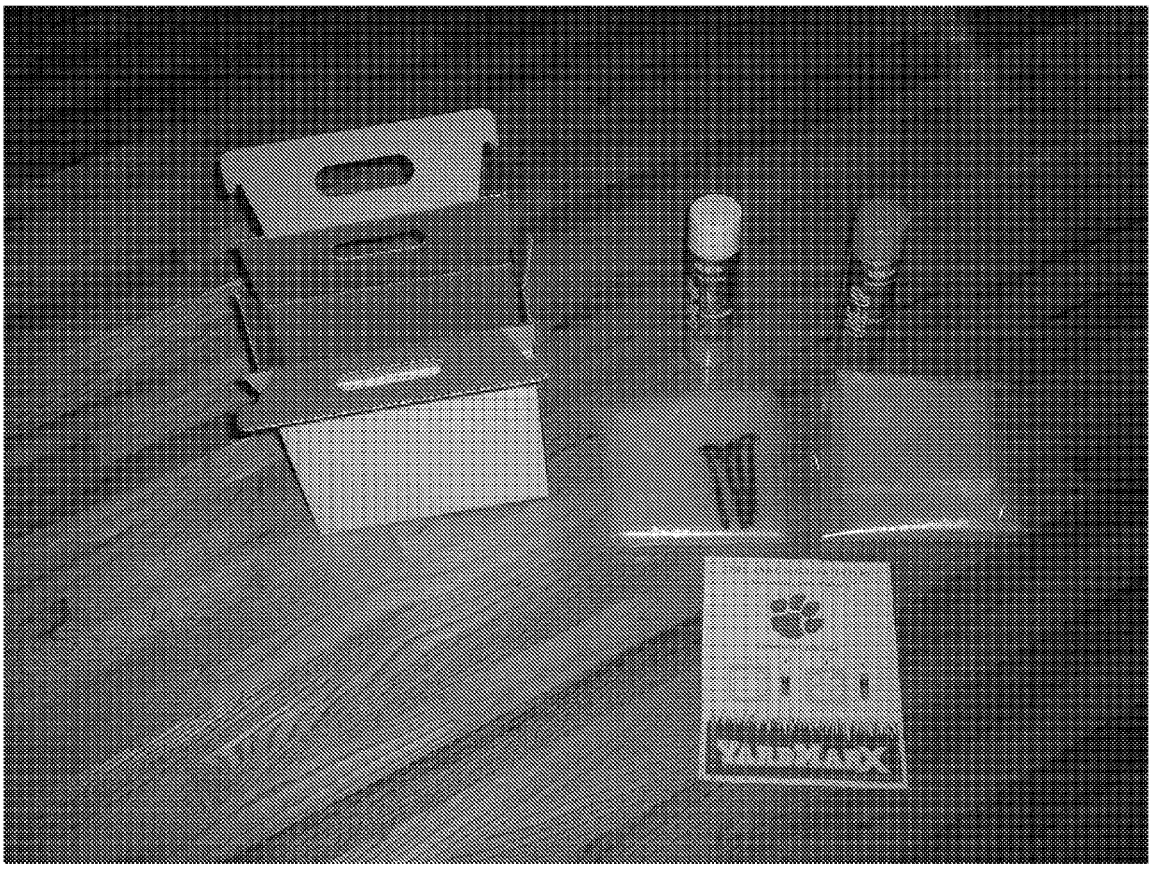
FIG. 16 illustrates the components of a kit spread out on a floor in accordance with an embodiment of the present invention.
Figure 17:
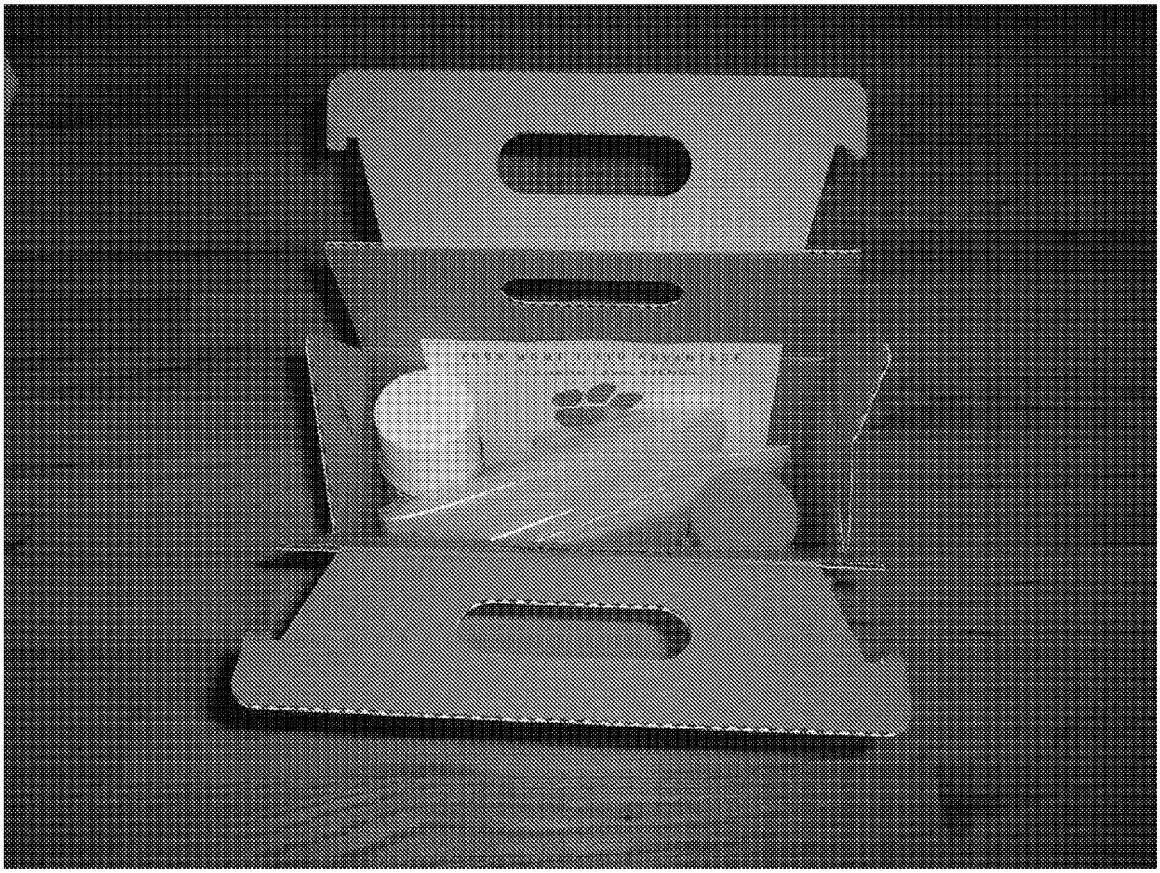
FIG. 17 illustrates the kit of FIG. 16 wherein components of the kit have been placed in the container.
Figure 18:
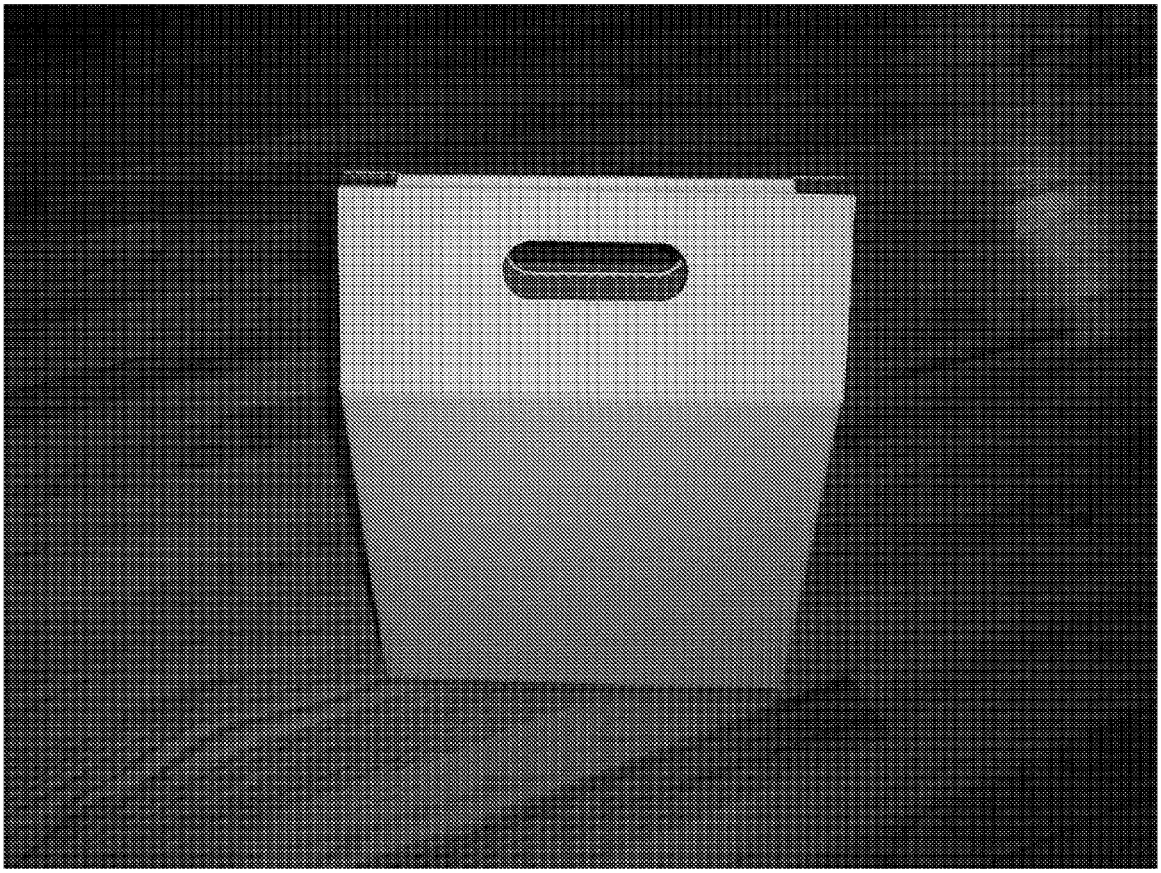
FIG. 18 illustrates the container of FIG. 17 in a closed configuration.

FIG. 16 illustrates the components of a kit spread out on a floor in accordance with an embodiment of the present invention. FIG. 17 illustrates the kit of FIG. 16 wherein components of the kit have been placed in the container, and FIG. 18 illustrates the container of FIG. 17 in a closed configuration.

The descriptions set forth above are not intended, nor are to be construed, to limit the general breadth of the present invention or otherwise to exclude any such other embodiments, adaptations, variations, modifications and equivalent arrangements, the present invention being limited only by the claims appended in an issued patent therefor, and the equivalents thereof.

Thus, while the preferred embodiments disclosed herein relate to creating artwork on a residential lawn, the present invention also may be utilized in creating artwork on other surfaces, such as parking lots, playgrounds, vehicles, and sports fields. The artwork also can be created on snow covered lawns and grounds, as well as on cement and other structural surfaces, such as the surface of a wall.

Furthermore, while preferred embodiments of the present invention have been described with reference to containers comprising aerosols for spray-paint, it is contemplated that powders, liquids, and/or adhesive films could be used in creating one or more of the design elements of the artwork.

What is claimed is:

1. A method for creating an artistic work on a lawn, comprising the steps of:

(a) anchoring a first lawn stencil to a lawn, including stretching taut the first lawn stencil such that the first lawn stencil lies substantially flat over the area of the lawn to which it is anchored, wherein the first lawn stencil comprises a planar sheet of flexible film in which a first pattern of one or more openings are defined, and wherein the first lawn stencil comprises a gate that extends across an opening of the pattern of openings and maintains structural integrity of the first lawn stencil and distributes tension in the first lawn stencil when the first lawn stencil is stretched taut;

(b) applying paint of a first color in a first desired pattern on the lawn by applying paint over the first pattern of one or more openings in the first lawn stencil;

(c) anchoring a second lawn stencil to the lawn; and (d) applying paint of a second color in a second desired pattern on the lawn by applying paint over a second pattern of one or more openings in the second lawn stencil, wherein the pattern of one or more openings in each lawn stencil corresponds to one or more design elements of the artistic work to be created on the lawn.

2. The method of claim 1, wherein the second lawn stencil comprises a planar sheet of flexible film in which the second pattern of one or more openings is defined, and wherein the planar sheet of film of each lawn stencil is about five feet in height and about five feet in length so as to cover about a twenty-five square foot area of the lawn and has a thickness of between two millimeters and six millimeters.

3. The method of claim 1, wherein each lawn stencil is adapted for folding and storage in a container having a relatively small form factor dimensioned for point-of-sale display and purchase at retail stores by consumers.

4. The method of claim 1, wherein the first lawn stencil includes at least two alignment locations for proper alignment of the first lawn stencil on the area of the lawn when the first design element of the artistic work is applied using the first lawn stencil, and wherein the second lawn stencil includes at least two alignment locations for proper alignment of the second lawn stencil on the area of the lawn when the second design element of the artistic work is applied using the second lawn stencil; and wherein the method further includes the step of aligning the first lawn stencil and aligning the second lawn stencil such that the alignment locations of each lawn stencil overlap common locations on the lawn.

5. The method of claim 1, wherein the first lawn stencil includes an indication of orientation for proper orientation of the first lawn stencil on the lawn when the first design element of the artistic work is to be applied using the first lawn stencil, and wherein the second lawn stencil includes an indication of orientation for proper orientation of the second lawn stencil on the lawn when the second design element of the artistic work is to be applied using the second lawn stencil, and wherein the method further includes orienting the first lawn stencil and orienting the second lawn stencil such that the indications of orientation of each lawn stencil are oriented in similar manner.

6. The method of claim 1, wherein the second lawn stencil, when anchored to the lawn, is located in overlapping relation to the first lawn stencil anchored to the lawn.

7. A method of creating an artistic work of art on a lawn includes the steps of:

(a) first, (i) unfolding and positioning a first lawn stencil over an area of the lawn where the artistic work is to be created, (ii) stretching taut the first lawn stencil and anchoring the first lawn stencil to the area of the lawn such that the first lawn stencil lies substantially flat over the area of the lawn by driving stakes into the ground, each stake extending through a respective anchor opening of the first lawn stencil that is located in a corner of the first lawn stencil, (iii) applying a layer of paint in a desired pattern on the area of the lawn by spraying paint over a pattern of one or more openings in the first lawn stencil, the pattern of one or more openings in the first lawn stencil corresponding to one or more design elements of the artistic work to be created, (iv) removing the first lawn stencil from the area of the lawn while leaving in place the stakes driven into the ground in said step (a)(ii), and (v) touching up an outline of the pattern of the one or more openings to completely fill-in the outline formed in said step (a)(iii); and (b) second, (i) unfolding and positioning a second lawn stencil over the area of the lawn where the artistic work is to be created, (ii) stretching taut the second lawn stencil and anchoring the second lawn stencil to the area of the lawn such that the second lawn stencil lies substantially flat over the area of the lawn by extending stakes driven into the ground in said step (a)(ii) through respective anchor opening of the second lawn stencil that are located in corners of the second lawn stencil without withdrawing the stakes from the lawn, (iii) applying a second layer of paint in a desired pattern on the area of the lawn by spraying paint over a pattern of one or more openings in the second lawn stencil, the pattern of one or more openings in the second lawn stencil corresponding to one or more design elements of the artistic work to be created, (iv) removing the second lawn stencil from the area of the lawn, and (v) touching up an outline of the pattern of the one or more openings to completely fill-in the outline formed in said step (b)(iii).

8. The method of claim 7, wherein each lawn stencil comprises a planar sheet of flexible film in which the first pattern of openings are defined and a gate that extends across an opening of the respective pattern of openings in the lawn stencil and maintains structural integrity of the lawn stencil and distributes tension in the lawn stencil when the lawn stencil is stretched taut.

9. The method of claim 7, wherein each lawn stencil comprises a planar, generally rectangular sheet of flexible film in which the respective pattern of openings is defined, each lawn stencil further having an indication of orientation located thereon.

10. The method of claim 9, wherein the planar sheet of film of each lawn stencil is about five feet in height and about five feet in length so as to cover about a twenty-five square foot area of the lawn and has a thickness of between two millimeters and six millimeters, and wherein each lawn stencil is adapted for folding and storage in a container having a relatively small form factor dimensioned for point-of-sale display and purchase at retail stores by consumers.

11. The method of claim 7, wherein a stake that is extended through an anchor opening of the first lawn stencil includes a circumferential flange dimensioned and configured such that the first lawn stencil is retained between the circumferential flange of the stake and the lawn.

12. The method of claim 11, wherein the second lawn stencil is resilient and recovers upon being stretched over the circumferential flange of the stake when the second lawn stencil is stretched taut and anchored to the lawn in said step (b)(ii).

13. The method of claim 7, wherein:

the first lawn stencil includes at least two alignment locations for proper alignment of the lawn stencil on the area of the lawn when the first design element of the artistic work is applied in said step (a)(iii) using the lawn stencil, and wherein the second lawn stencil includes at least two alignment locations for proper alignment of the second lawn stencil on the area of the lawn when the second design element of the artistic work is applied in said step (b)(iii) using the second lawn stencil; and the method further includes the step of aligning the first lawn stencil in said step (a)(iii) and aligning the second lawn stencil in said step (b)(iii) such that the alignment locations of each lawn stencil overlap common locations on the lawn.

14. The method of claim 7, wherein the first lawn stencil includes an indication of orientation for proper orientation of the lawn stencil on the lawn when the first design element of the artistic work is applied using the first lawn stencil; wherein the second lawn stencil includes an indication of orientation for proper orientation of the second lawn stencil on the lawn when the second design element of the artistic work is applied using the second lawn stencil; and wherein the method further includes orienting the first lawn stencil in said step (a)(iii) and orienting the second lawn stencil in said step (b)(iii) such that the indications of orientation of each lawn stencil are oriented in similar manner when the respective layer of paint is applied.

15. A method for creating an artistic work on a lawn, comprising the steps of:

(a) anchoring a first lawn stencil to a lawn;

(b) applying paint of a first color in a first desired pattern on the lawn by applying paint over a first pattern of one or more openings in the first lawn stencil;

(c) anchoring a second lawn stencil to the lawn;

(d) applying paint of a second color in a second desired pattern on the lawn by applying paint over a second pattern of one or more openings in the second lawn stencil;

(e) wherein the pattern of one or more openings in each lawn stencil corresponds to one or more design elements of the artistic work to be created on the lawn;

(f) wherein the step of anchoring the first lawn stencil to the lawn includes first laying the first lawn stencil upon the lawn and then driving stakes into the lawn through anchor openings in the first lawn stencil; and (g) wherein the step of anchoring the second lawn stencil to the lawn includes laying the second lawn stencil upon the lawn, such that stakes already driven into the lawn extend through anchor openings in the second lawn stencil, by stretching the second lawn stencil over a top of each of the stakes.

16. The method of claim 15, wherein the second lawn stencil, when anchored to the lawn is located in overlapping relation to the first lawn stencil anchored to the lawn.

17. The method of claim 16, wherein a stake that is extended through an anchor opening of the first lawn stencil includes a circumferential flange dimensioned and configured such that the first lawn stencil is retained between the circumferential flange of the stake and the lawn.

18. The method of claim 17, wherein the second lawn stencil is resilient and recovers upon being stretched over the circumferential flange of the stake when the second lawn stencil is anchored to the lawn.

19. The method of claim 15, wherein each lawn stencil comprises a planar sheet of flexible film in which the respective pattern of openings is defined, and wherein the planar sheet of film of each lawn stencil is about five feet in height and about five feet in length so as to cover about a twenty-five square foot area of the lawn and has a thickness of between two millimeters and six millimeters.

20. The method of claim 15, wherein the first lawn stencil includes an indication of orientation for proper orientation of the first lawn stencil on the lawn when the first design element of the artistic work is to be applied using the first lawn stencil, and wherein the second lawn stencil includes an indication of orientation for proper orientation of the second lawn stencil on the lawn when the second design element of the artistic work is to be applied using the second lawn stencil, and wherein the method further includes orienting the first lawn stencil and orienting the second lawn stencil such that the indications of orientation of each lawn stencil are oriented in similar manner.

* * * * *